US012201884B2

(12) United States Patent
Henrikson et al.

(10) Patent No.: US 12,201,884 B2
(45) Date of Patent: Jan. 21, 2025

(54) GOLF CLUB HEAD HAVING A MAGNETIC ADJUSTABLE WEIGHTING SYSTEM

(71) Applicant: KARSTEN MANUFACTURING CORPORATION, Phoenix, AZ (US)

(72) Inventors: Erik M. Henrikson, Phoenix, AZ (US); Samuel Pendred, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/059,888

(22) Filed: Nov. 29, 2022

(65) Prior Publication Data

US 2023/0087233 A1 Mar. 23, 2023

Related U.S. Application Data

(63) Continuation of application No. 17/009,663, filed on Sep. 1, 2020, now Pat. No. 11,511,170, which is a (Continued)

(51) Int. Cl.
*A63B 53/06* (2015.01)
*A63B 53/04* (2015.01)
(Continued)

(52) U.S. Cl.
CPC ..... *A63B 60/04* (2015.10); *A63B 53/0466* (2013.01); *A63B 53/047* (2013.01); *A63B 53/0487* (2013.01); *A63B 53/06* (2013.01); *A63B 53/08* (2013.01); *A63B 60/02* (2015.10); *A63B 53/0433* (2020.08); *A63B 53/0445* (2020.08); *A63B 2053/0479* (2013.01); *A63B 2053/0491* (2013.01);
(Continued)

(58) Field of Classification Search
CPC ..... A63B 2053/0491; A63B 53/06; A63B 53/065
See application file for complete search history.

(56) References Cited

U.S. PATENT DOCUMENTS 3,419,275 A 12/1968 Winkleman
4,017,082 A 4/1977 Channing
(Continued)

FOREIGN PATENT DOCUMENTS

GB 2459045 10/2009
GB 2459045 A * 10/2009 ..... A63B 53/0487
(Continued)

OTHER PUBLICATIONS

Blaine R. Copenheaver, PCT, ISR &Written Opinion of the International Searching Authority, mailed Aug. 7, 2017, Alexandria VA USA; corresponding to PCT/US2017/038011.

*Primary Examiner* — Alvin A Hunter

(57) ABSTRACT

A golf club head includes a club body having a crown opposite a sole, a toe end opposite a heel end, a back end, and a hosel. A first magnet is coupled to the club body. A second magnet selectively engages the first magnet, such that in a first configuration the first and second magnets attract, and in a second configuration the first and second magnets do not attract, wherein the second magnet is configured to rotate relative to the first magnet between the first configuration and the second configuration.

13 Claims, 12 Drawing Sheets

Related U.S. Application Data continuation of application No. 15/625,959, filed on Jun. 16, 2017, now Pat. No. 10,773,139.

(60) Provisional application No. 62/500,629, filed on May 3, 2017, provisional application No. 62/414,566, filed on Oct. 28, 2016, provisional application No. 62/351,804, filed on Jun. 17, 2016.

(51) Int. Cl.

| | |
|---|---|
| ***A63B 53/08*** | (2015.01) |
| ***A63B 60/02*** | (2015.01) |
| ***A63B 60/04*** | (2015.01) |
| *A63B 60/42* | (2015.01) |
| *A63B 102/32* | (2015.01) |

(52) U.S. Cl.

CPC ..... *A63B 2053/0495* (2013.01); *A63B 60/42* (2015.10); *A63B 2102/32* (2015.10); *A63B 2209/08* (2013.01)

(56) References Cited

U.S. PATENT DOCUMENTS

| | | | | |
|---|---|---|---|---|
| 4,857,873 | A * | 8/1989 | Gillings | H01F 7/0252 433/189 |
| 5,127,970 | A * | 7/1992 | Kim | B22F 9/023 148/101 |
| 5,366,222 | A | 11/1994 | Lee | |
| 5,482,282 | A | 1/1996 | Willis | |
| 5,911,637 | A | 6/1999 | Yamagata | |
| 6,015,354 | A | 1/2000 | Ahn et al. | |
| 6,171,204 | B1 | 1/2001 | Starry | |
| 6,176,792 | B1 | 1/2001 | Tate | |
| 6,200,226 | B1 | 3/2001 | Regan | |
| 6,296,574 | B1 | 10/2001 | Kaldis | |
| 6,450,903 | B1 | 9/2002 | Tate | |
| 6,863,620 | B2 | 3/2005 | Tucker | |
| 7,070,514 | B1 | 7/2006 | Borunda | |
| 7,101,290 | B2 | 9/2006 | Tucker, Sr. | |
| 7,431,662 | B2 | 10/2008 | Tucker | |
| 7,448,959 | B2 | 11/2008 | Blankenship et al. | |
| 7,666,108 | B2 | 2/2010 | Bryant | |
| 7,744,485 | B2 * | 6/2010 | Jones | A63B 60/02 473/409 |
| 7,887,432 | B2 * | 2/2011 | Jones | A63B 53/0487 473/409 |
| 7,896,753 | B2 | 3/2011 | Boyd et al. | |
| 7,938,739 | B2 | 5/2011 | Cole | |
| 8,033,930 | B2 | 10/2011 | Tavares | |
| 8,313,393 | B1 | 11/2012 | Toxen | |
| 8,721,472 | B2 * | 5/2014 | Kuan | A63B 53/0487 473/340 |
| 8,740,722 | B2 | 6/2014 | Sato | |
| 8,814,722 | B2 * | 8/2014 | Stites | A63B 53/0466 473/334 |
| 9,111,672 | B2 | 8/2015 | Fullerton et al. | |
| 9,205,311 | B2 * | 12/2015 | Stokke | A63B 60/00 |
| 9,440,123 | B2 * | 9/2016 | Beno | A63B 60/42 |
| 9,504,889 | B2 | 11/2016 | Mitzel | |
| 9,630,069 | B2 | 4/2017 | Foster | |
| 9,694,256 | B2 | 7/2017 | Myers | |
| 9,821,198 | B2 * | 11/2017 | Stokke | A63B 60/00 |
| 9,855,474 | B2 * | 1/2018 | Beno | A63B 53/0466 |
| 10,500,459 | B2 * | 12/2019 | Stokke | A63B 53/0466 |
| 10,773,139 | B2 | 9/2020 | Henrikson | |
| 11,559,729 | B2 * | 1/2023 | Stokke | A63B 53/06 |
| 2006/0122004 | A1 | 6/2006 | Chen | |
| 2006/0166754 | A1 | 7/2006 | Kang | |
| 2006/0276258 | A1 | 12/2006 | McLaughlin | |
| 2007/0021233 | A1 | 1/2007 | Blankenship | |
| 2009/0105009 | A1 | 4/2009 | Cole | |
| 2009/0258725 | A1 * | 10/2009 | Jones | A63B 53/0487 473/341 |
| 2010/0016098 | A1 * | 1/2010 | Tavares | A63B 53/0466 473/345 |
| 2010/0113176 | A1 * | 5/2010 | Boyd | A63B 53/0466 473/409 |
| 2010/0222155 | A1 * | 9/2010 | Jones | A63B 53/0487 473/341 |
| 2010/0267467 | A1 | 10/2010 | Stites et al. | |
| 2013/0324299 | A1 | 12/2013 | Clausen | |
| 2014/0248976 | A1 * | 9/2014 | Stokke | A63B 60/02 473/335 |
| 2016/0001143 | A1 * | 1/2016 | Yang | A63B 60/50 473/333 |
| 2016/0023059 | A1 | 1/2016 | Miller | |
| 2016/0067568 | A1 * | 3/2016 | Stokke | A63B 60/02 473/349 |
| 2016/0067570 | A1 | 3/2016 | Larson | |
| 2017/0361185 | A1 * | 12/2017 | Henrikson | A63B 60/04 |
| 2018/0043220 | A1 * | 2/2018 | Stokke | A63B 53/06 |
| 2018/0147461 | A1 * | 5/2018 | Stokke | A63B 53/04 |
| 2018/0311547 | A1 * | 11/2018 | Busch | A63B 53/007 |
| 2019/0351295 | A1 * | 11/2019 | Tezuka | A63B 53/023 |
| 2020/0101359 | A1 * | 4/2020 | Stokke | A63B 60/00 |
| 2023/0124924 | A1 * | 4/2023 | Stokke | A63B 53/0466 473/335 |

FOREIGN PATENT DOCUMENTS

| | | | |
|---|---|---|---|
| JP | H05175037 | A * | 7/1993 |
| JP | 2010158316 | | 7/2010 |
| JP | 5391693 | B2 * | 1/2014 |
| KR | 20100035745 | A * | 4/2010 |

* cited by examiner

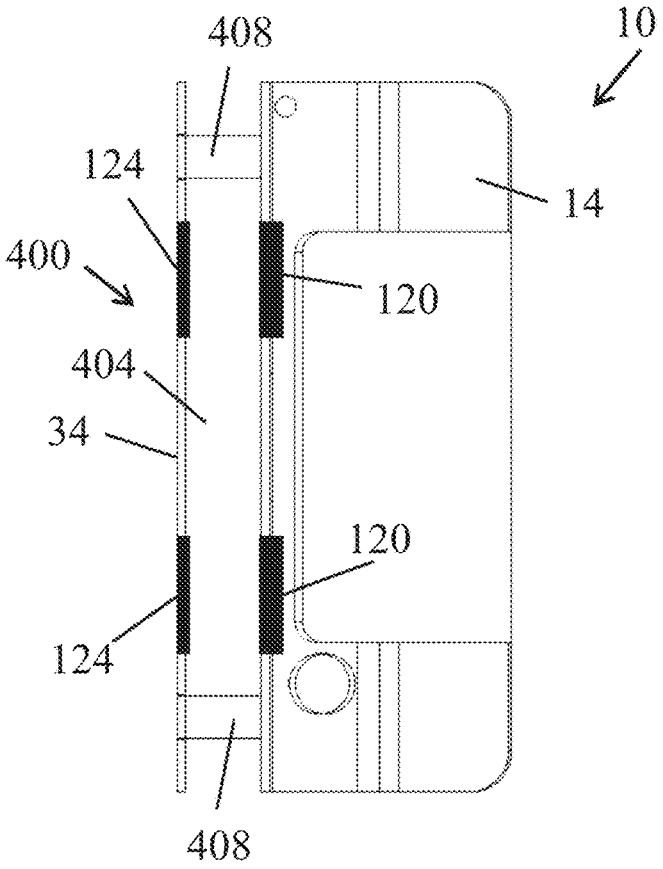
FIG. 10A
FIG. 10B
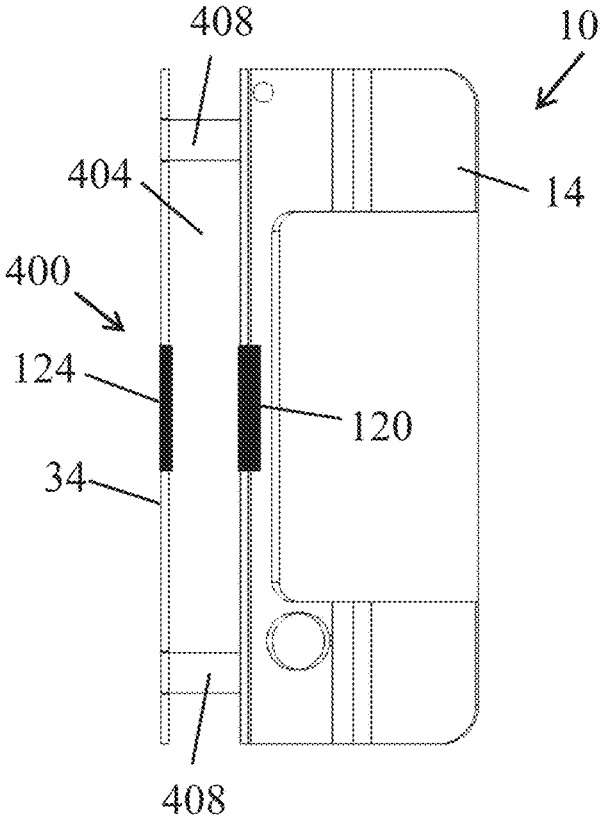

GOLF CLUB HEAD HAVING A MAGNETIC ADJUSTABLE WEIGHTING SYSTEM

CROSS-REFERENCE TO RELATED APPLICATIONS

This is a continuation of U.S. patent application Ser. No. 17/009,663 filed Sep. 1, 2020, now U.S. Pat. No. 11,511,170 issued Nov. 29, 2022, which is a continuation of U.S. patent application Ser. No. 15/625,959 filed Jun. 16, 2017, now U.S. Pat. No. 10,773,139 issued Sep. 15, 2020, which claims the benefit of U.S. Provisional Patent Appl. No. 62/500,629, filed on May 3, 2017, U.S. Provisional Patent Appl. No. 62/414,566, filed on Oct. 28, 2016, and U.S. Provisional Patent Appl. No. 62/351,804, filed on Jun. 17, 2016, the contents of which are incorporated fully herein by reference.

FIELD OF THE INVENTION

The present disclosure relates to a golf club, and more specifically to an adjustable magnetic weighting system for a golf club head to facilitate selective attachment and removal of the weight to the golf club head.

BACKGROUND

Golf clubs take various forms, for example a wood, a hybrid, an iron, a wedge, or a putter, and these clubs generally differ in head shape and design (e.g., the difference between a wood and an iron, etc.), club head material(s), shaft material(s), club length, and club loft.

Center of gravity, moment of inertia, and weight bias of the golf club head are functions of the distribution of mass of the golf club head. In particular, distributing mass of the club head to be closer to a sole portion of the club head, closer to a strikeface of the club head, and/or closer to a toe portion and heel portion of the club head can alter the center of gravity, the moment of inertia, and/or the weight bias of the club head. Altering the center of gravity of the club head can alter the launch angle of the golf ball, the spin rate of the golf ball, and/or flight angle of the golf ball. Altering the moment of inertia of the club head can alter the forgiveness of the golf club, flight direction of the golf ball, and/or flight angle of the golf ball. Increasing the flight angle of a golf ball can increase the distance the golf ball travels. Altering the weight bias of the club head can adjust the ball flight of the golf ball, and/or the position of the golf club head sweet spot. For example, more weight towards a toe end of the golf club head will impart a fade (or a slice) bias, increasing the likelihood that the ball travels with a fade (or slice) trajectory. Similarly, more weight towards a heel end of the golf club head will impart a draw (or a hook) bias, increasing the likelihood that the ball travels with a draw (or hook) trajectory.

Swingweight of the golf club is a function of the distribution of weight of the golf club. An increase in the amount of weight in the club head relative to a grip end will result in an increase in swingweight (and the club will feel heavier during a swing). Conversely, a decrease in the amount of weight in the club head relative to the grip end will result in a decrease in swingweight (and the club will feel lighter during the swing).

While golf clubs have a variety of known designs, there is a need for adjustability of the distribution of mass on the golf club head to improve weight distribution customization. This can allow a player to customize one or more of the center of gravity position, moment of inertia, weight bias, weight distributions, and swing weight to adjust the forgiveness, spin rate, flight angle, flight trajectory, swingweight, and/or feedback (or "club feel") of the golf club.

BRIEF DESCRIPTION OF THE DRAWINGS

FIGS. 10A, 10B, and 10C are perspective views of the golf club head of FIG. 1, illustrating another embodiment of a magnetic adjustable weighting system.

DETAILED DESCRIPTION

Figure 1:
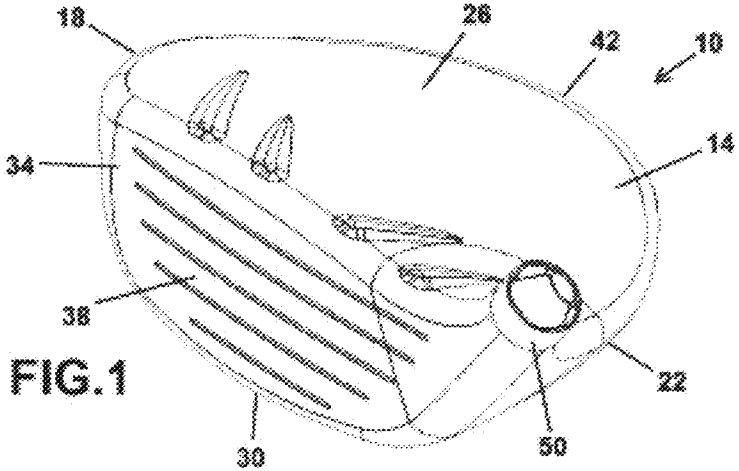
FIG. 1 is a perspective view of an embodiment of a golf club head.

Described herein are embodiments of golf club heads having adjustable weighting systems that comprise programmable magnets. Many embodiments include one or more sets of programmable magnets that can be repositioned or replaced with magnets or weights of varying mass to change the club head center of gravity and/or moment of inertia. Accordingly, the adjustable weighting systems having the programmable magnets can be used by a golfer to alter the ball spin and/or trajectory. Further, the adjustable weighting systems having the programmable magnets can be used to alter ball spin and/or trajectory during club fitting.

One embodiment includes a golf club head having a club body having a crown opposite a sole, a toe end opposite a heel end, a back end, and a hosel. The golf club head also includes a first magnet that is configured to be coupled to the club body. A second magnet is selectively engageable with the first magnet, such that in a first configuration the first and second magnets attract, and in a second configuration the first and second magnets do not attract. The second magnet is configured to rotate relative to the first magnet between the first configuration and the second configuration.

In another embodiment, the golf club head includes a club body having a crown opposite a sole, a toe end opposite a heel end, a back end, and a hosel. A channel is formed in the sole. A programmed magnet pair includes a first magnet and a second magnet. The first magnet is positioned in the channel. The second magnet is configured to operatively couple to the first magnet. In a first configuration the first and second magnets attract, and in a second configuration the first and second magnets do not attract.

In another embodiment, the golf club head includes a club body having a crown opposite a sole, a toe end opposite a heel end, a back end, and a hosel. A programmed magnet pair includes a first magnet and a second magnet. The first magnet is configured to be coupled to the club body, and the second magnet is configured to selectively couple to the first magnet.

In yet another embodiment, the golf club head includes a club body having a crown opposite a sole, a toe end opposite a heel end, a back end, and a hosel. A first magnet is coupled to the club body. A second magnet is configured to operatively connect to the first magnet, and a third magnet is configured to operatively connect to the first magnet. The first and second magnets are a first programmed magnet pair, and the first and third magnets are a second programmed magnet pair.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Figure 10C:
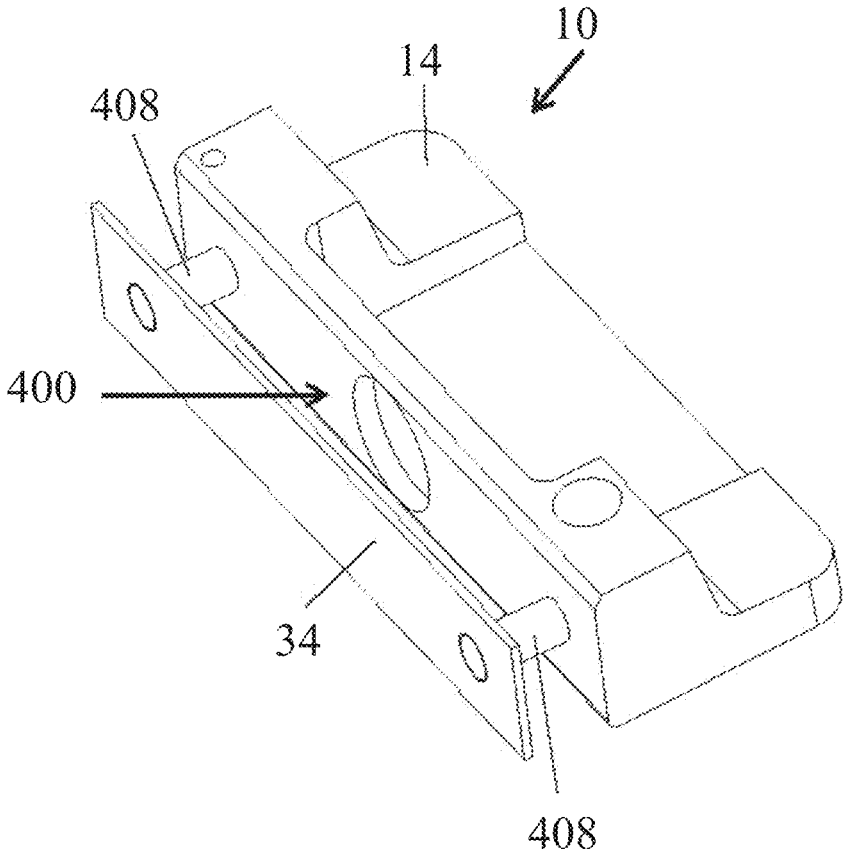
Figure 11:
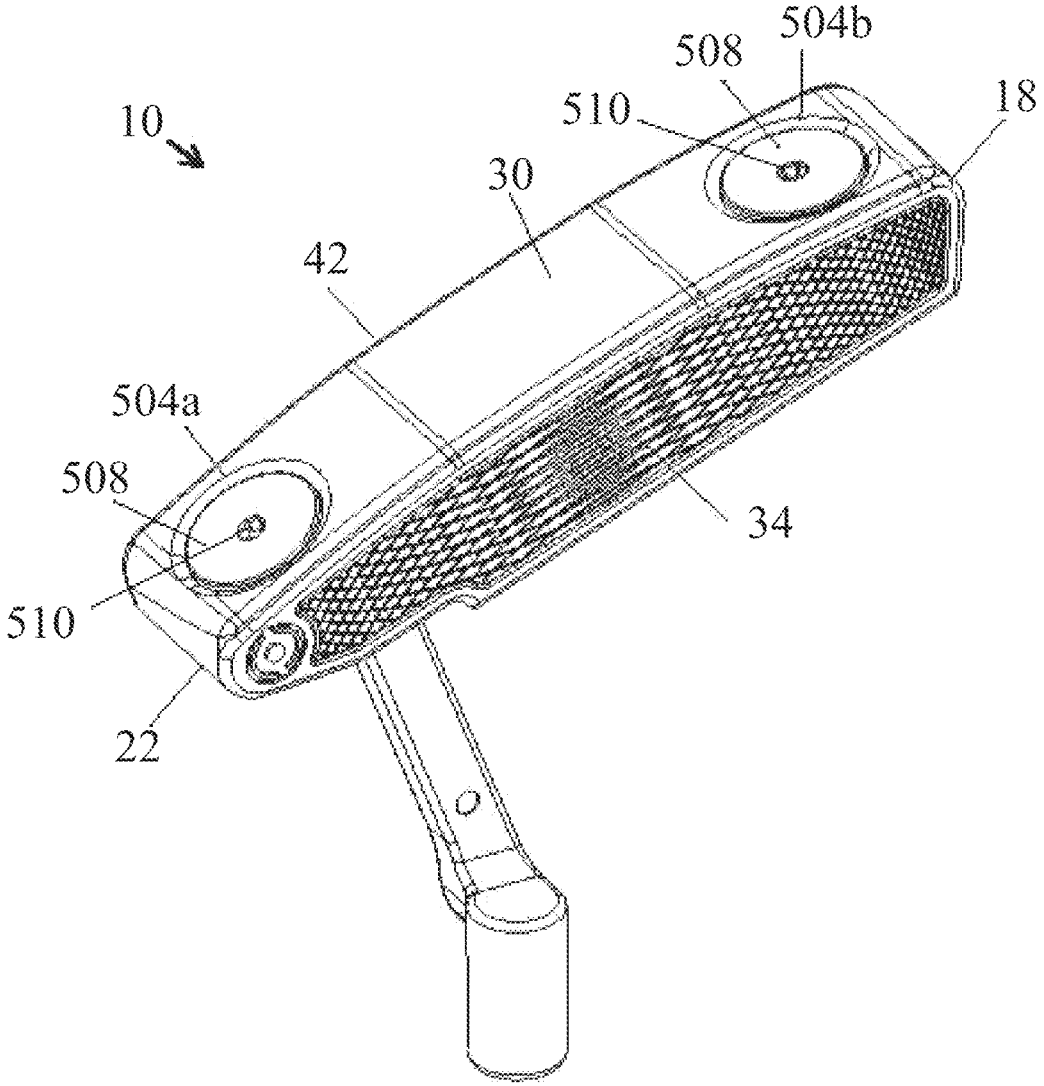
FIG. 11 is a perspective view of a putter golf club head, illustrating another embodiment of a magnetic adjustable weighting system.

For ease of discussion and understanding, and for purposes of description only, the following detailed description illustrates a golf club head 10 as a fairway wood (FIGS. 1-3), a driver (FIGS. 4-5 and 7-9), and a putter (FIGS. 10-11). It should be appreciated that the fairway wood, driver, and putter are provided for purposes of illustration of one or more embodiments of a magnetic adjustable weighting system 100, 200, 300, 400, 500 as disclosed herein. The disclosed system 100, 200, 300, 400, 500 can be used on any desired golf club head 10, including a wood, a hybrid, an iron, a putter, or other golf club where one or more weights can be adjustably positioned on the golf club head 10. For example, the club head 10 can include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 10 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61, 61.5, 62, 62.5, 63, 63.5, 64, 64.5, and/or 65 degrees).

Figure 2:
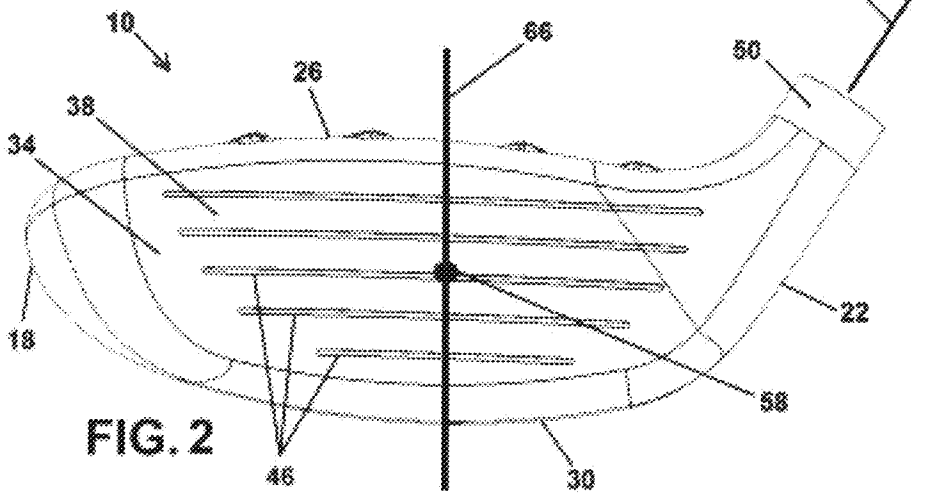
FIG. 2 is a first side view of the club head of FIG. 1, illustrating a face plate.
Figure 3:
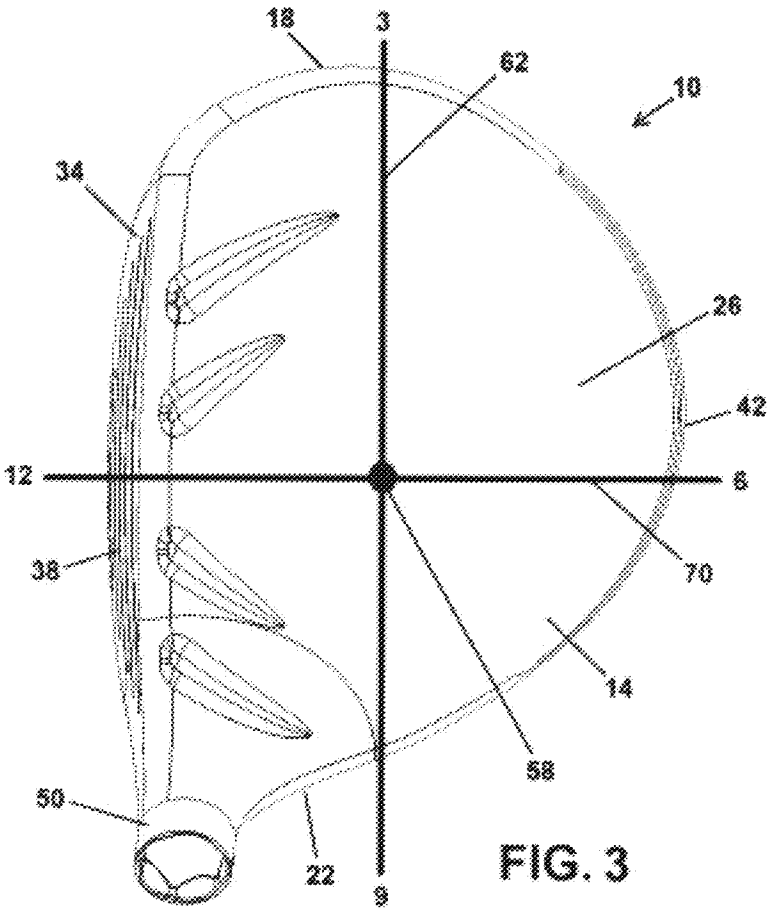
FIG. 3 is a top (or crown) view of the club head of FIG. 1.

Referring now to the figures, FIGS. 1-3 illustrate an embodiment of the golf club head 10 that incorporates one or more embodiments of the magnetic adjustable weighting system 100, 200, 300, 400, 500 disclosed herein. The golf club head 10 includes a club body 14 (or body 14) having a toe end 18 (or toe 18) opposite a heel end 22 (or heel 22). The body 14 also includes a crown 26 (or top 26) opposite a sole 30 (or bottom 30). The body 14 carries a face plate 34 (or strike plate 34 or club face 34) that defines a strike surface 38. The face plate 34 is positioned opposite a back 42 (or rear end 42 or rear 42 or back side 42) (shown in FIGS. 1 and 3). A plurality of grooves 46 (shown in FIG. 2) can be positioned on the face plate 34. The golf club head 10 also includes a hosel 50 having a hosel axis 54 (shown in FIG. 2) that extends through a center of the hosel 50. The hosel 50 is configured to receive a golf club shaft (not shown) that carries a grip (not shown).

Referring now to FIGS. 2-3, the golf club head 10 includes a center of gravity or CG 58 that defines an origin of a coordinate system including an x-axis 62, a y-axis 66, and a z-axis 70. The x-axis 62 (shown in FIG. 3) extends through the club head 10 center of gravity 58 from the toe end 18 to the heel end 22. The y-axis 66 (shown in FIG. 2) extends through the club head 10 center of gravity 58 from the crown 26 to the sole 30. The z-axis 70 (shown in FIG. 3) extends through the center of gravity 58 of the club head 10 from the face plate 34 to the back 42. For additional guidance in describing the innovation herein, the x-axis 62 and the z-axis 70 are arranged to coincide with numbers on an analog clock in FIG. 3. The z-axis 70 extends between 12 o'clock ("12" through the face plate 34) and 6 o'clock ("6"

through the back 42), and the x-axis 62 extends between 3 o'clock ("3" through the toe end 18) and 9 o'clock ("9" through the heel end 22).

Various golf club head parameters are important in achieving desired performance characteristics, such as club head moment of inertia, club head center of gravity position, and club head center of gravity adjustability. High club head moment of inertia results in increased club head forgiveness for off-center hits. A club head center of gravity positioned low and back (i.e. toward the sole and rear of the club head) beneficially increases moment of inertia, reduces backspin, and increases launch angle of a golf ball on impact. Club head center of gravity adjustability allows for desired trajectory tuning of a club head by an end user. Each of these parameters are important in golf club design to achieve desired or optimal performance characteristics. However, including all of these parameters on a golf club head presents a design challenge, as many current center of gravity adjustability mechanisms (1) lower club head moment of inertia and/or (2) shift the club head center of gravity up and toward the front of the club head due to internal and/or bulky weight structures, and/or non-optimal weight structure positioning.

The embodiments of the golf club heads described below include adjustable weighting systems while maintaining or preventing a significant reduction in club head moment of inertia, and low and back club head center of gravity positioning. For example, many embodiments below describe low profile adjustable weighting systems and/or optimally positioned adjustable weighting systems to maintain a high club head moment of inertia and low and back club head center of gravity position, similar to a club head devoid of an adjustable weighting system, while providing user adjustability of ball flight and/or trajectory. Maintaining a high club head moment of inertia about the club head CG results in increased forgiveness for off-center hits, and maintaining a high club head moment if inertia about the hosel axis results in increased rotational stability during a swing. Further, maintaining a low and back club head center of gravity beneficially increases club head moment of inertia about the head CG and reduces backspin.

The adjustable weighting system 66 is adjustable by an end user to modify the club head 10 center of gravity 50 and/or moment of inertia and/or heel/toe bias to achieve desired performance characteristics (e.g., forgiveness, spin, trajectory) under various circumstances. In these or other embodiments, shifting the head center of gravity toward the toe can generate a fade or correct for a hook. Conversely, shifting the head center of gravity toward the heel can generate a draw or correct for a slice. In the embodiments of the magnetic adjustable weighting system described below, shifting head center of gravity in a direction extending between the heel and toe a distance between 0.10 and 0.30 inch can result in a change in shot bend of 4.6 to 13.9 yards.

Figure 6:
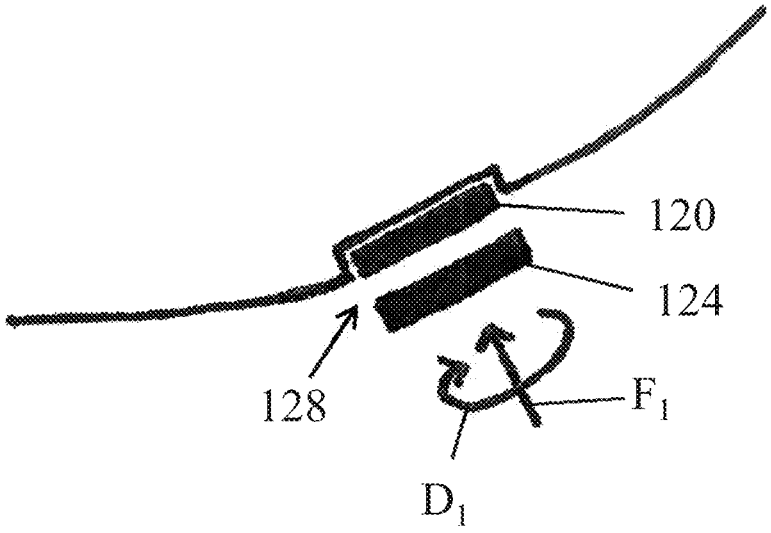
FIG. 6 is a perspective view of a magnet assembly for attaching a weight to the golf club head of FIG. 1, showing a first magnet and a second magnet in a first configuration in which the magnets attract.
Figure 7:
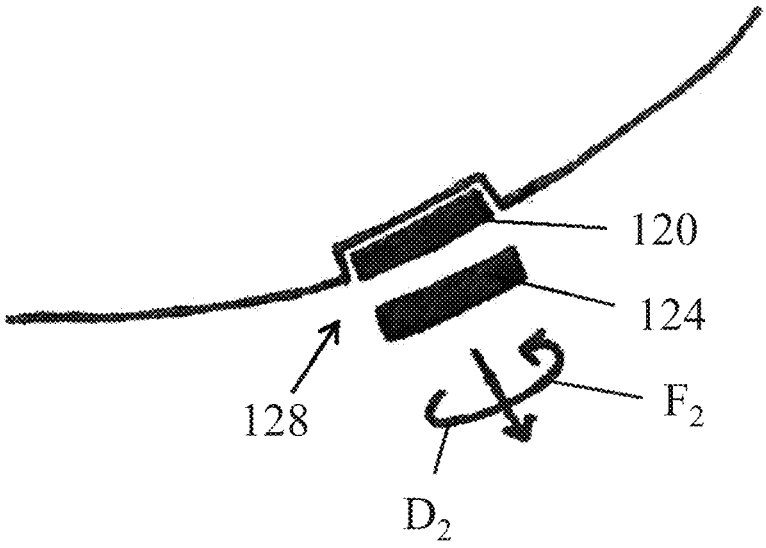
FIG. 7 is a perspective view of the magnet assembly of FIG. 6, showing the first magnet and the second magnet in a second configuration in which the magnets repel.

The embodiments of the magnetic adjustable weighting systems described below (i.e. the magnetic adjustable weighting system 100 of FIGS. 4-5, the magnetic adjustable weighting system 200 of FIGS. 8A-8C, the magnetic adjustable weighting system 300 of FIG. 9, the magnetic adjustable weighting system 400 of FIGS. 10A-10C, the magnetic adjustable weighting system 500 of FIGS. 11 and 12) include one or more sets of programmed magnets. Referring to FIGS. 6 and 7, each set of programmed magnets includes a first magnet 120 and a second magnet 124 that form a magnet assembly 128. In some embodiments, the second magnet 124 acts as a weight that can be shifted or replaced to alter the weighting of the club head 10. In some embodiments, the magnet assembly facilitates attachment of a weight to the golf club head 10, wherein the weight can be shifted or replaced to alter the weighting of the club head 10.

As programmed magnets, the first and second magnets 120, 124 define a correlated magnet pair. In addition, the magnets 120, 124 can be programmed to interact with magnetic structures coded to respond. More specifically, the magnets 120, 124 can be programmed with multi-pole structures that include multiple magnetic elements (or magnetic pixels, called "maxels") of varying size, location, orientation, and/or saturation. The maxels can be arranged in a defined pattern to vary polarity and/or magnetic field strength to generate a customized magnetic field. This results in an increase in holding force and an increase in shear resistance as compared to a magnetic field formed by a conventional magnet (e.g., four or more times the holding force or shear resistance than a conventional magnet). An example of programmed, correlated magnets includes POLYMAGNETS® that are sold by Correlated Magnetics Research, LLC of New Hope, Alabama.

In the illustrated embodiment, the correlated first and second magnets 120, 124 are programmed to attract in a first configuration (or orientation), and not attract (or repel) in a second configuration (or orientation). FIG. 6 illustrates the first magnet 120 and the second magnet 124 oriented with respect to each other in the first configuration. In this first configuration, the patterns arranged on the first magnet 120 and/or the second magnet 124 are configured to form an attractive force $F_1$ (or attract). To achieve the first configuration, one of the magnets 120, 124 is rotated relative to the other magnet 124, 120. For example, the second magnet 124 can be rotated relative to the first magnet 120 in a first direction $D_1$ (e.g., clockwise, etc.). Once the second magnet 124 is rotated into the first configuration, the magnets 120, 124 attract (or are "locked" together).

Rotating one of the magnets 120, 124 relative to the other magnet 124, 120 in a second direction $D_2$ (e.g., counterclockwise, etc.) can achieve the second configuration. FIG. 7 illustrates the first magnet 120 and the second magnet 124 oriented with respect to each other in the second configuration. In this second configuration, the patterns arranged on the first magnet 120 and/or the second magnet 124 are configured to form a repelling force $F_2$ (or repel). The second configuration is achieved by rotating the second magnet 124 relative to the first magnet 120 in the second direction $D_2$, which is opposite the first direction $D_1$ (e.g., with a torque wrench or other suitable device). Once in the second configuration, the magnets 120, 124 repel (or are "unlocked" and can be removed).

While FIGS. 6-7 respectively illustrate the magnet assembly 128 having a locked and unlocked behavioral functionality, in other embodiments, the magnet assembly 128 (and the associated magnets 120 and/or 124) can be programmed to have additional or alternative functionality. For example, one or both magnets 120, 124 can be programmed to not only attach or repel, they can be programmed to align, latch, and/or have a proximity system. For example, the proximity system of the magnets 120, 124 can be programmed to attract with an equal strength up to a set distance apart (e.g., ten millimeters or less apart, etc.). Once the distance apart has been exceeded (i.e., the magnets 120, 124 are more than ten millimeters apart, etc.) the magnets 120, 124 transition to repel one another.

The magnets 120, 124 can be any suitable size or shape. For example, the magnets 120, 124 can have a diameter of approximately 0.25 inches to approximately 2.00 inches, and more specifically can have a diameter of approximately 0.25 inches to approximately 1.50 inches, and more specifically can have a diameter of approximately 0.50 inches to approximately 1.25 inches. In other embodiments, the magnets 120, 124 can have a diameter of at least 1.00 inch. It should be appreciated that each magnet 120, 124 can have the same diameter, or can be different diameters.

The magnets 120, 124 can have any suitable weight (or mass). For example, the mass of the second magnet 124 can be 0.10, 0.25, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5, 20.0, 20.5, 21.0, 21.5, 22.0, 22.5, 23.0, 23.5, 24.0, 24.5, 25.0, 25.5, 30.0, 30.5, 31.0, 31.5, 32.0, 32.5, 33.0, 33.5, 34.0, 34.5, 35.0, 35.5, 36.0, 36.5, 37.0, 37.5, 38.0, 38.5, 39.0, 39.5, 40.0, 40.5, 41.0, 41.5, 42.0, 42.5, 43.0, 43.5, 44.0, 44.5, 45.0, 45.5, 46.0, 46.5, 47.0, 47.5, 48.0, 48.5, 49.0, 49.5, or 50.0 grams. In addition, the mass of the second magnet 124 can provide any suitable increment of weight (e.g., 0.10 grams, 0.25 grams, 0.50 grams, 0.75 grams, etc.). In some embodiments, the second magnet 124 can be one of a plurality of second magnets 124. Each of the plurality of second magnets 124 can have a different mass to customize weight distribution of the golf club head 10.

The magnets 120, 124 can also have a thickness of approximately 0.075 inches to approximately 1.750 inches, and more specifically 0.100 inches to approximately 0.1500 inches. In other embodiments, the magnets 120, 124 can have a thickness of at least approximately 0.125 inches.

Each of the magnets 120, 124 can have a volume of approximately 0.50 $cm^3$ to approximately 1.30 $cm^3$, and more specifically approximately 0.75 $cm^3$ to approximately 1.00 $cm^3$, and more specifically at least 0.90 $cm^3$. In other embodiments, each magnet 120, 124 can have any suitable or desired volume.

The magnets 120, 124 can have a pull force of approximately ten pounds (10 lbs.) to fifty pounds (50 lbs.), and more specifically approximately fifteen pounds (15 lbs.) to thirty pounds (30 lbs.). In other embodiments, the magnets 120, 124 can have a pull force of approximately 15 lbs., 16 lbs., 17 lbs., 18 lbs., 19 lbs., 20 lbs., 21 lbs., 22 lbs., 23 lbs., 24 lbs., 25 lbs., 26 lbs., 27 lbs., 28 lbs., 29 lbs., or 30 lbs. (approximately 45 N (Newton's) to 223 N (Newton's)). In the illustrated embodiment, the magnets 120, 124 are made of NdFeB (Neodymium). The magnets 120, 124 can have a grade of N35 to N52, and more specifically a grade of N40 to N52. In other embodiments, the magnets 120, 124 can have a grade of at least N40. In yet other embodiments, the magnets 120, 124 can have a grade in excess of N40. In other embodiments, the magnets 120, 124 can be made of any suitable magnetic material, such as iron ferrites, tungsten, aluminum, steel, chromium, nickel, vanadium, lomedium, rare-earth metals, ceramics or electromagnets.

As a non-limiting example, each magnet 120, 124 can be made of NdFeB (Neodymium), which has a density of approximately 7.30 $g/cm^3$ to approximately 7.80 $g/cm^3$, and more specifically a density of at least approximately 7.50 $g/cm^3$. Such a magnet 120, 124 with a volume of approximately 0.90 $m^3$ results in a mass of approximately 6.57 grams to approximately 7.05 grams, and more specifically a mass of at least approximately 6.75 grams. It should be appreciated that magnets 120, 124 formed of one or more different materials can have a different density. In addition, magnets 120, 124 can have a different size and/or volume, resulting in a different mass.

Figure 4:
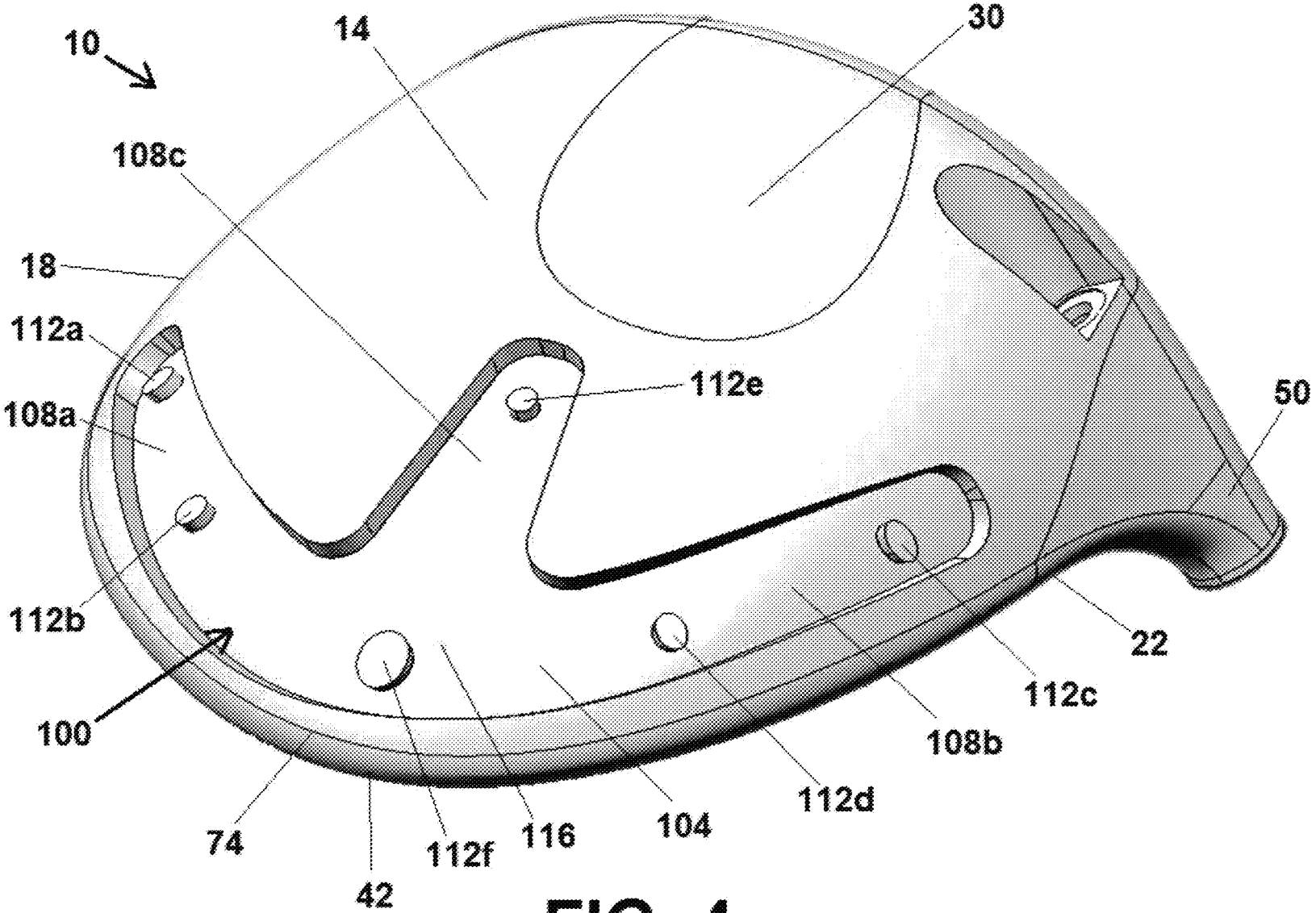
FIG. 4 is a perspective view of a sole of the golf club of FIG. 1 viewed from the back towards the face plate, illustrating an embodiment of a magnetic adjustable weighting system.
Figure 5:
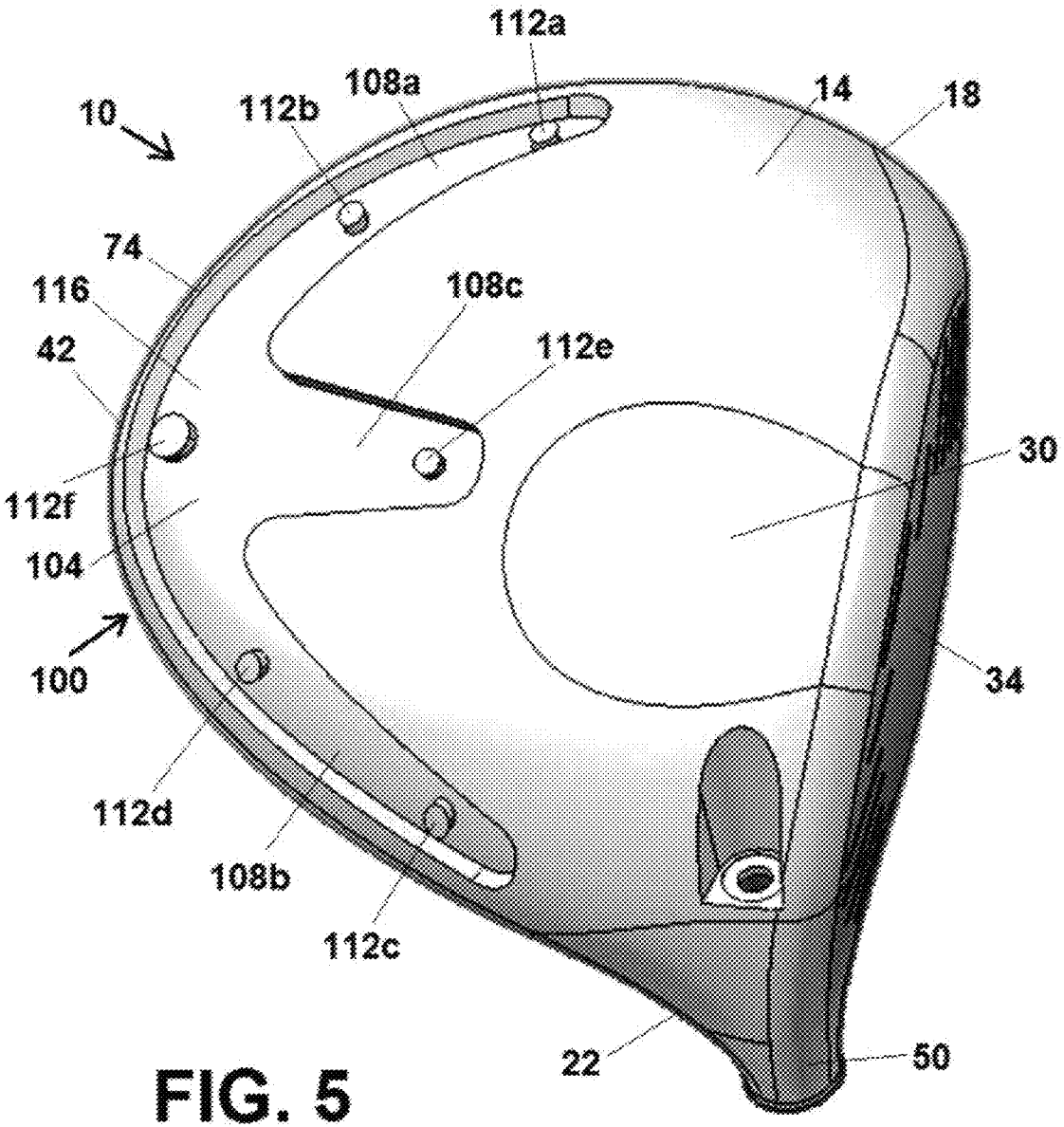
FIG. 5 is another perspective view of the sole of FIG. 4.
Figure 8A:
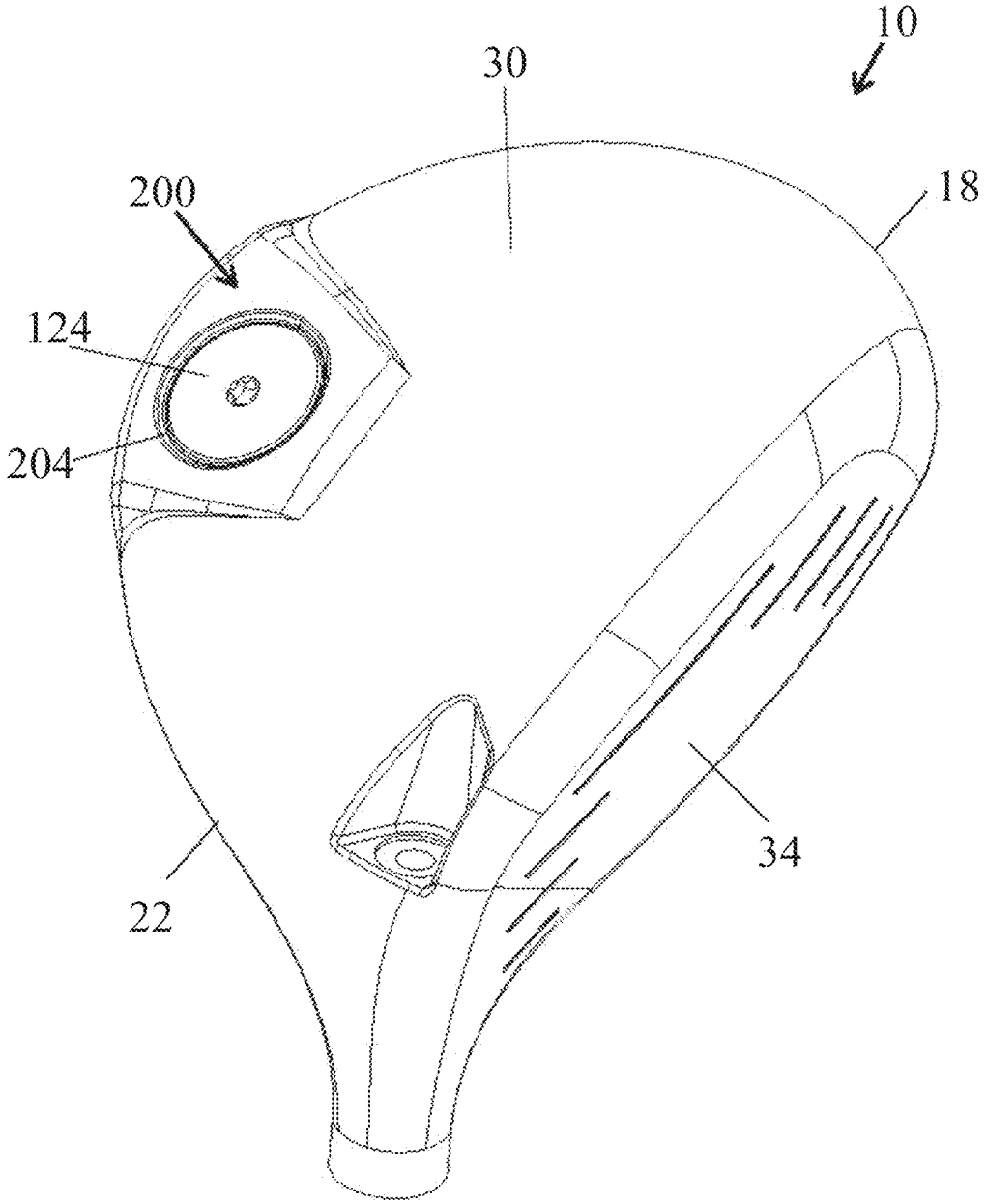
FIGS. 8A, 8B, and 8C are perspective views of the sole of the golf club of FIG. 1, illustrating another embodiment of a magnetic adjustable weighting system.
Figure 8B:
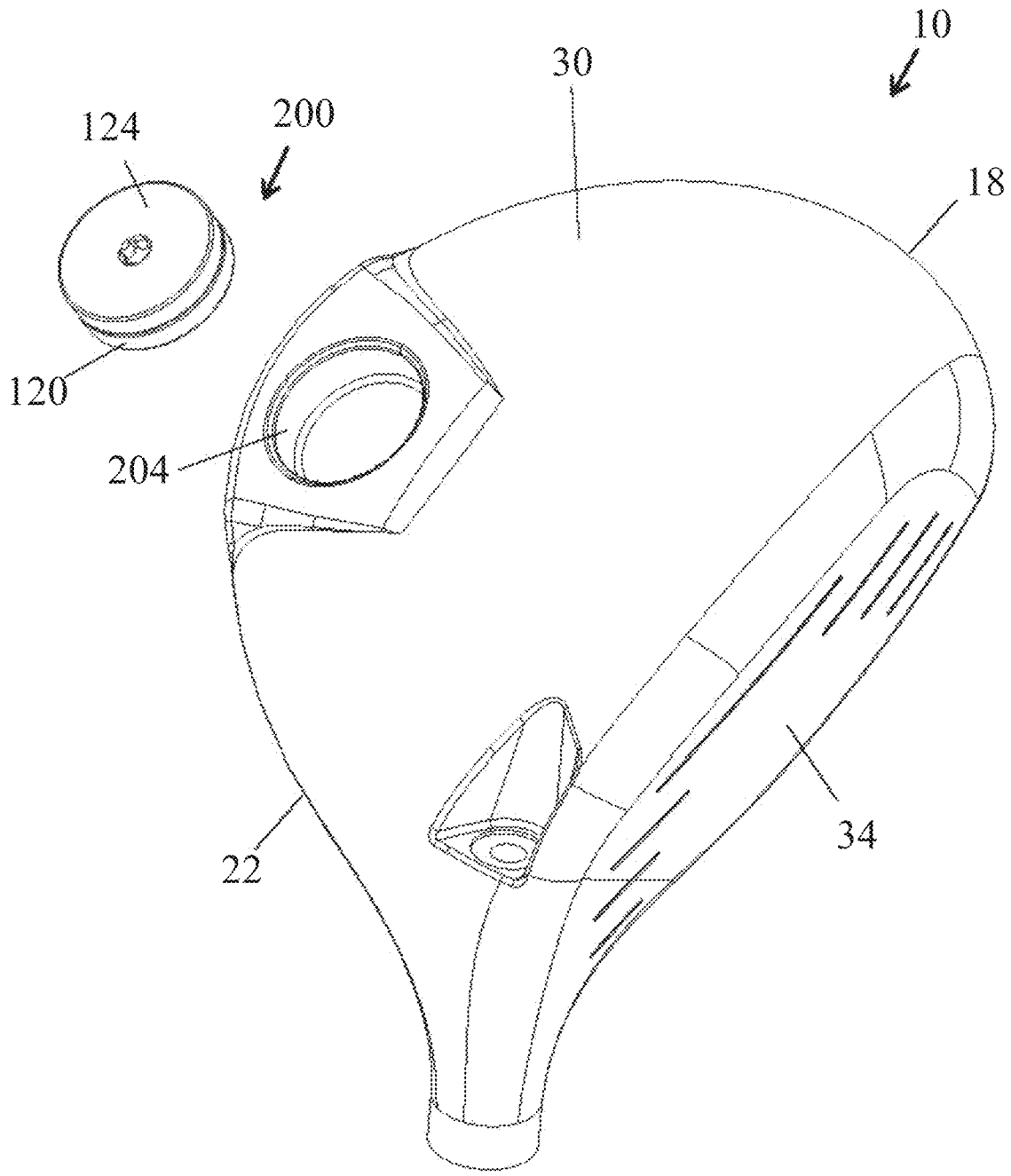
Figure 8C:
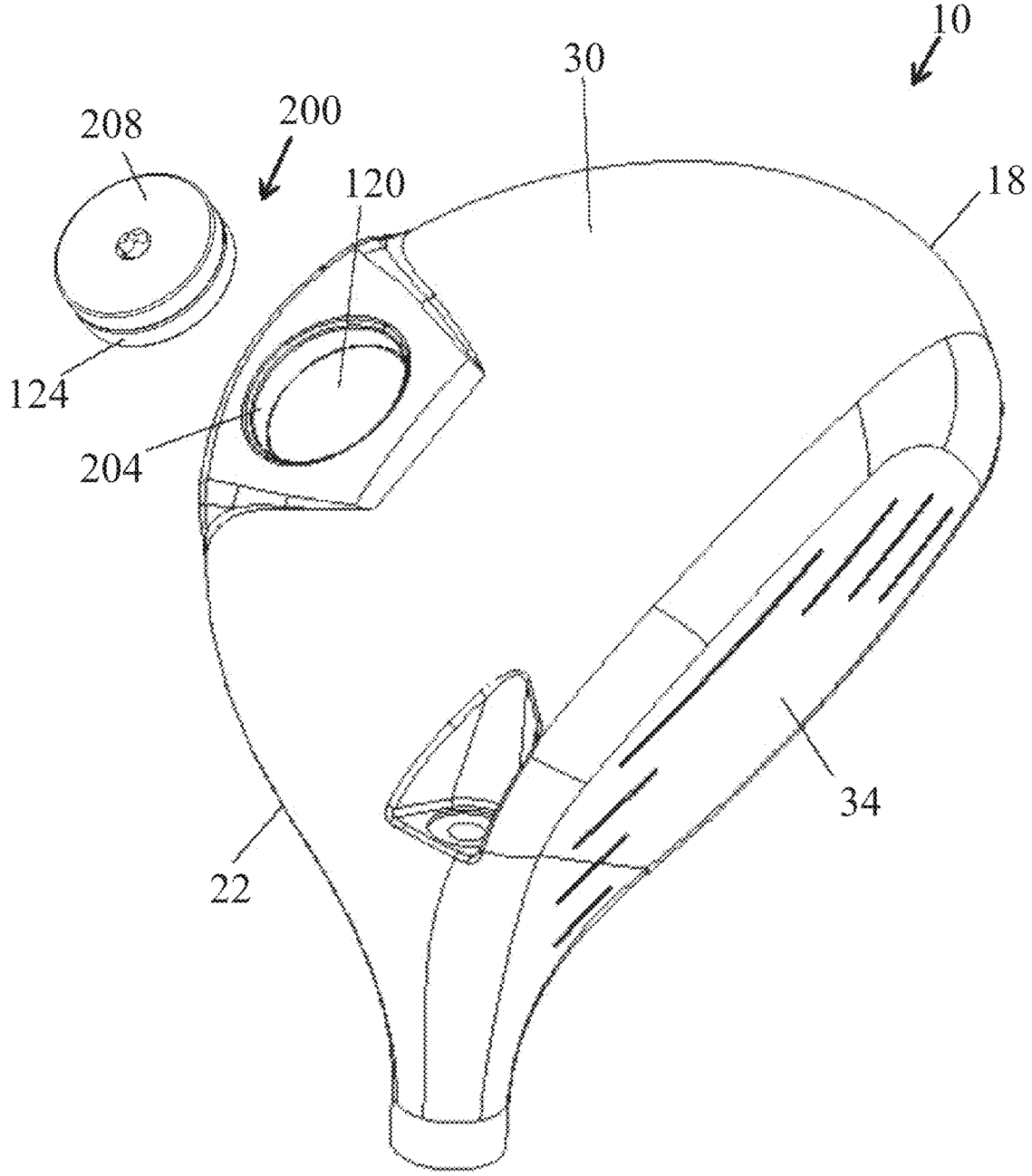
Figure 9:
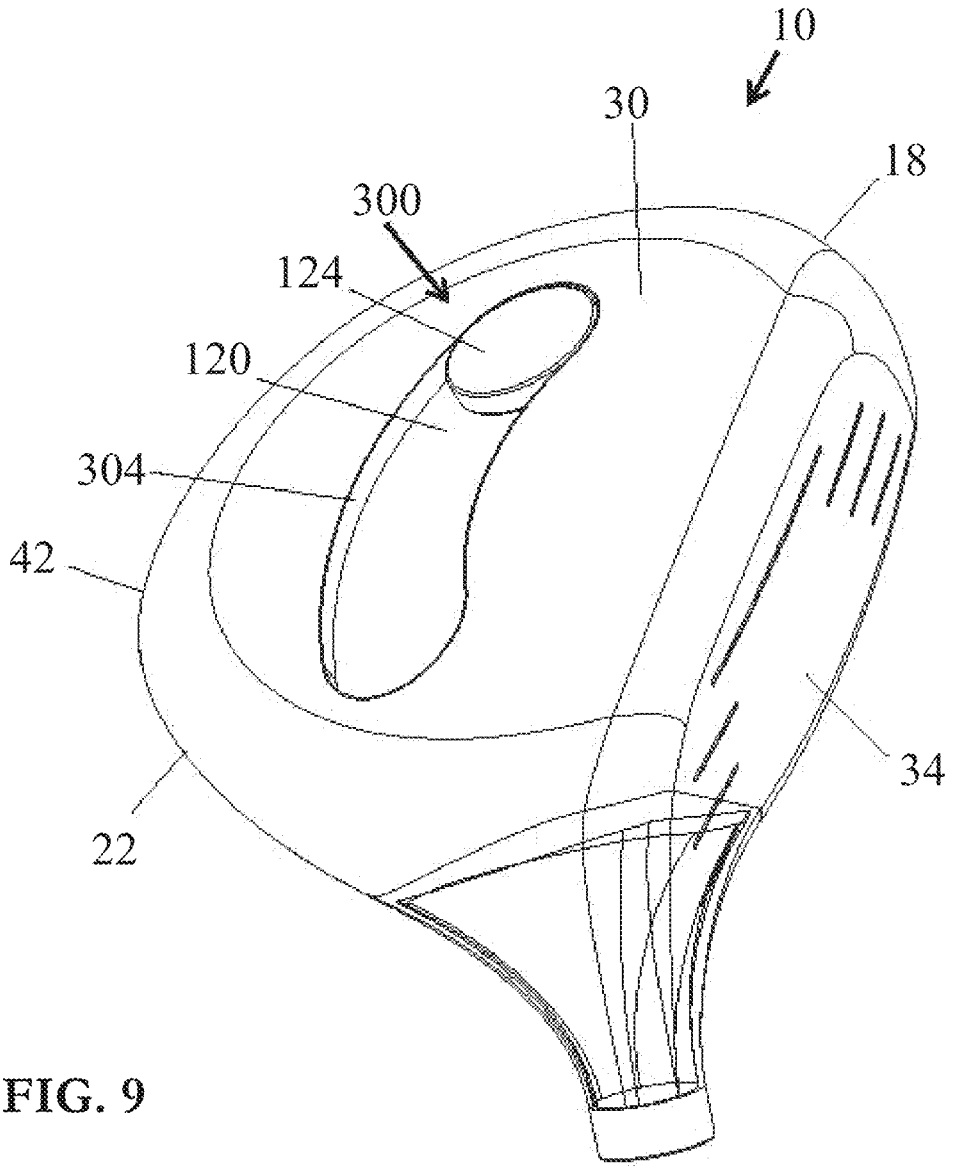
FIG. 9 is a perspective view of the sole of the golf club of FIG. 1, illustrating yet another embodiment of a magnetic adjustable weighting system.
Figure 12:
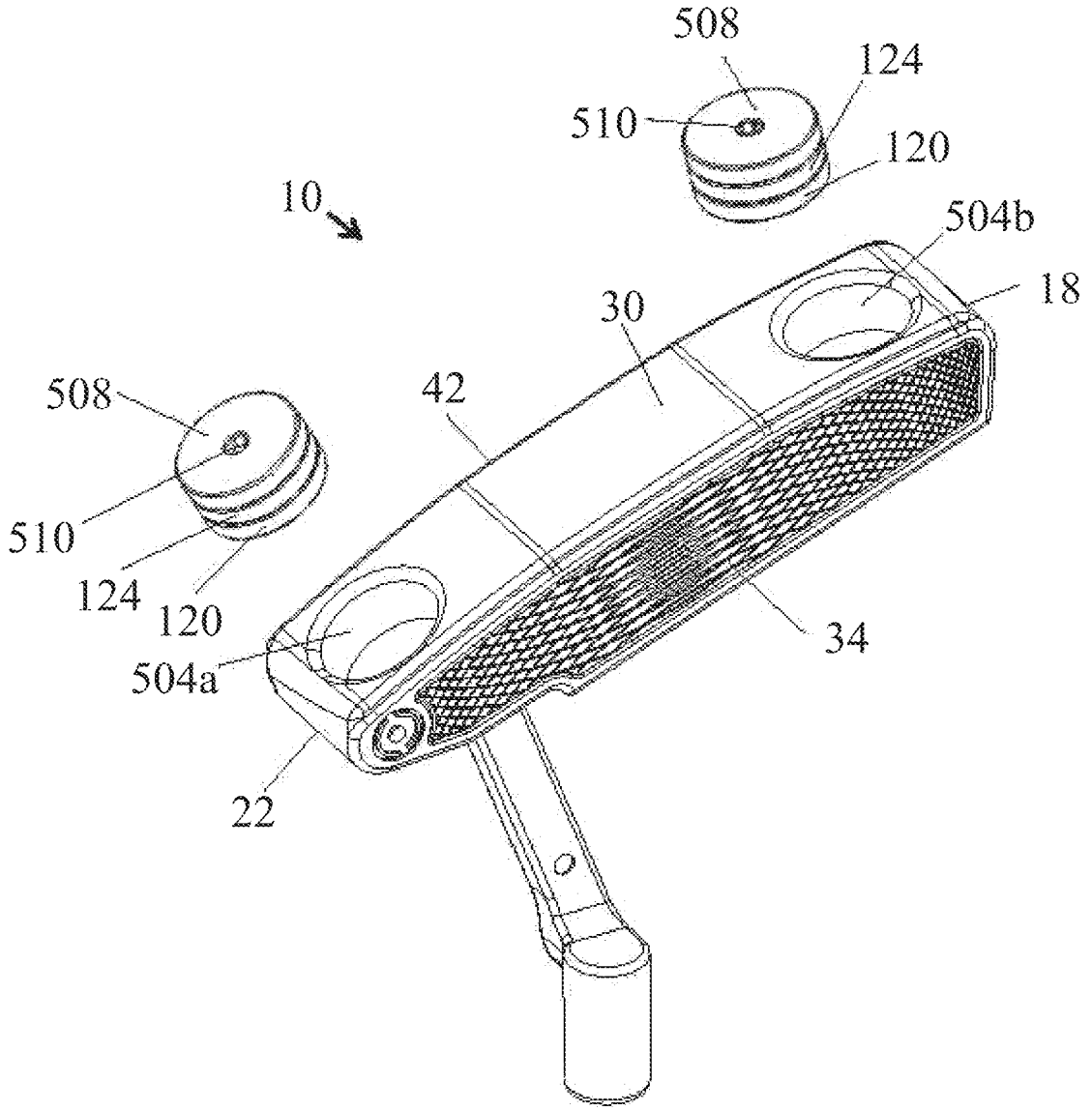
FIG. 12 is a perspective view of the club head of FIG. 11, illustrating the weights as removed.

The magnets described above relative to FIGS. 6 and 7, and the associated parameters and configurations thereof, can apply to the magnetic adjustable weighting system 100 of FIGS. 4-5, the magnetic adjustable weighting system 200 of FIGS. 8A-8C, the magnetic adjustable weighting system 300 of FIG. 9, the magnetic adjustable weighting system 400 of FIGS. 10A-10C, the magnetic adjustable weighting system 500 of FIGS. 11 and 12.

As illustrated in FIGS. 4-5, the golf club head 10 can include a rail 74 (or skirt 74). The rail 74 defines a transition area between the crown 26 (shown in FIGS. 1-3) and the sole 30. The rail 74 generally extends around the body 14 of the golf club head 10 from an end of the face plate 34 (shown in FIG. 5) at the toe end 18 to the hosel 50 at the heel end 22. In other embodiments, the rail 74 can generally extend around the body 14 of the golf club head 10 from an end of the face plate 34 at the toe end 18 to an end of the face plate 34 at the heel end 22. In the illustrated embodiment, the rail 74 is generally curved (or arcuate) in shape. However, in other embodiments the rail 74 can have any suitable shape (e.g., angled, etc.).

FIGS. 4-5 also illustrate an embodiment of the magnetic adjustable weighting system 100. The system 100 includes a recess 104 that is positioned on the sole 30 of the golf club head 10. The recess 104 is a single recess 104 that can extend from the toe end 18 towards the heel end 22. In the illustrated embodiment, the recess 104 is an arcuate recess that extends along a portion of the rail 74. The recess 104 is positioned on the sole 30 closer to the rear 42 than to the face plate 34. However, in other embodiments, the recess 104 can be positioned at any suitable position on the sole 30 and/or the rail 74, and can be any suitable shape (e.g., a straight line, etc.).

The recess 104 can include at least one channel 108, and preferably a plurality of channels 108. The illustrated recess 104 includes a first channel **108*a*, a second channel 108*b*, and a third channel 108*c*. In other embodiments, the recess 104 can include a single channel 108, two channels 108, or four or more channels 108**.

A plurality of weight mounting points 112 (or weight mounting positions 112) are positioned within the recess 104. In the illustrated embodiment, the recess 104 includes six weight mounting points 112. In other embodiments, the recess 104 can include any suitable number of weight mounting points 112 (e.g., one, two, three, four, five, seven, eight or more, etc.). Each channel **108*a*, 108*b*, 108*c* includes at least one weight mounting point 112. The first channel 108*a* includes a first weight mounting point 112*a* and a second weight mounting point 112*b*. The second channel 108*b* includes a third weight mounting point 112*c* and a fourth weight mounting point 112*d*. The third channel 108*c* includes a fifth weight mounting point 112*e*. A sixth weight mounting point 112*f* is positioned in the recess 104, and more specifically in a junction 116 that connects the first, second, and third channels 108*a, b, c*. Generally, each channel 108 includes at least one weight mounting point 112. In other embodiments, one or more weight mounting points 112 can be positioned at any suitable location on the golf club head 10 (e.g., the sole 30, the crown 26, the rail 74, the toe 18, outside of the recess 104**, etc.).

Each weight mounting point 112 can include a first magnet 120 (shown in FIG. 6). In the embodiment illustrated in FIGS. 4-5, each weight mounting point 112 is a first magnet 120 that is coupled to (or attached to or mounted to or formed with) the sole 30 of the golf club head 10. Stated another way, each weight mounting point 112 defines a first magnet 120. In other embodiments, each weight mounting point 112 can receive, house, or otherwise incorporate a first magnet 120 (e.g., each weight mounting point 112 can include a receptacle that receives the first magnet 120, etc.). The first magnet 120 is configured to selectively attach to a second magnet 124.

The magnets 120, 124 can have any suitable weight (or mass), density, and/or volume. For example, the second magnet 124, which is the removable magnet in the illustrated embodiment, can be one of a plurality of second magnets 124 having a mass (or weight). The mass of the second magnet 124 can be 0.10, 0.25, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5, 20.0, 20.5, 21.0, 21.5, 22.0, 22.5, 23.0, 23.5, 24.0, 24.5, 25.0, 25.5, 30.0, 30.5, 31.0, 31.5, 32.0, 32.5, 33.0, 33.5, 34.0, 34.5, 35.0, 35.5, 36.0, 36.5, 37.0, 37.5, 38.0, 38.5, 39.0, 39.5, 40.0, 40.5, 41.0, 41.5, 42.0, 42.5, 43.0, 43.5, 44.0, 44.5, 45.0, 45.5, 46.0, 46.5, 47.0, 47.5, 48.0, 48.5, 49.0, 49.5, or 50.0 grams. In addition, the mass of the second magnet 124 can provide any suitable increment of weight (e.g., 0.10 grams, 0.25 grams, 0.50 grams, 0.75 grams, etc.). The plurality of second magnets 124 can have the same mass or a different mass to customize weight distribution of the golf club head 10. One or more second magnet(s) 124 are configured to engage with (or operatively couple to, operatively connect to, selectively engage, selectively couple, or otherwise couple to) one or more of the weight mounting points 112. Stated another way, at least one second magnet 124 can be positioned on one of the weight mounting points 112. In addition, a plurality of second magnets 124 can be positioned on a corresponding plurality of weight mounting points 112. A plurality of second magnets 124 having different masses can be positioned on a corresponding plurality of weight mounting points 112 to adjust and/or customize a weight distribution, a swing weight, and/or the center of gravity 58 of the golf club head 10. In other example of embodiments, the second magnet 124 can be coupled to a separate mass (or a weight).

Referring now to FIGS. 8A-C, another embodiment of the magnetic adjustable weighting system 200 is illustrated. The magnetic adjustable weighting system 200 has similar components to the magnetic adjustable weighting system 100, with like names and/or like numbers identifying like components. The magnetic adjustable weighting system 200 includes a single weight mounting point 204, which is illustrated as a recess. The weight mounting point 204 can be positioned at any location on the golf club head 10. As illustrated, the weight mounting point 204 is positioned on the sole 30 closer to the rear 42 than to the strike plate 34. In other embodiments, the weight mounting point 204 can be positioned on the crown 26, another portion of the sole 30, or any other location on the body 14 of the golf club head 10.

Referring to FIGS. 8A and 8B, the weight mounting point 204 is coupled to (or includes or receives) the first magnet 120. More specifically, the first magnet 120 is received by the weight mounting point 204. The first magnet 120 is coupled to the interior of the weight mounting point 204 (or to a portion of the body 14 of the golf club head 10) by an adhesive. In other embodiments, the first magnet 120 can be coupled to the weight mounting point 204 by any suitable permanent (or semi-permanent) attachment (e.g., epoxy, glue, screw, rivets, etc.) or combination thereof. The first magnet 120 has a shape that generally conforms to the shape of the weight mounting point 204. While the first magnet 120 illustrated in FIGS. 8A and 8B has a circular shape that is configured to be received in a cylindrical shape of the weight mounting point 204, in other embodiments, the first magnet 120 can be any suitable shape (e.g., triangular, square, oval, polygonal, etc.).

In the illustrated embodiment, the weight mounting point 204 has a diameter that is slightly larger than the associated magnet 120, 124. More specifically, each mounting point 504 is approximately 0.05 inches larger than the diameter of the magnet 120, 124. In other embodiments, the mounting point 204 can have a diameter (or size) that is the same as the diameter (or size) of each associated magnet 120, 124. In yet other embodiments, the mounting point 204 can have a diameter (or size) that is larger than the diameter (or size) of each associated magnet 120, 124. More specifically, the mounting point 204 can have a diameter (or size) that is approximately 0.01 inches to approximately 0.10 inches larger than each associated magnet 120, 124, and more specifically approximately 0.025 inches to approximately 0.075 inches larger than each associated magnet 120, 124, and more specifically at least 0.05 inches larger than each associated magnet 120, 124. In addition, the weight mounting point 204 can have a taper or slope or draft to improve ease of insertion of each associated magnet 120. For example, in the illustrated embodiment, the weight mounting point 204 includes a 1.00° draft. In other embodiments, the weight mounting point 204 can include approximately a 0.25° draft to approximately a 2.00° draft, and more specifically a 0.50° draft to approximately a 1.75° draft, and more specifically a 0.75° draft to approximately a 1.50° draft, and more specifically at least a 1.00° draft. In other embodiments, the weight mounting point 204 can include no draft (or a 0° draft).

The second magnet 124 engages (or couples to or operatively couples to or selectively engages) the first magnet 120 when oriented in the first configuration, and disengages (or is removable from) the first magnet 120 when oriented in the second configuration. When in the second configuration, the second magnet 124 can be removed from the weight mounting point 204. A different second magnet 124*a* (not shown) can then be attached to the first magnet 120 at the weight mounting point 204. The second magnets 124, 124*a* are substantially the same except for the associated mass. More specifically, the second magnet 124 can have a first mass (or weight), while the second magnet 124*a* can have a second, different mass (or weight). As a non-limiting example, the second magnet 124 can be 10 grams, while the second magnet 124*a* can be 20 grams. Attachment of different second magnets 124, 124*a* of differing masses (or weights) can facilitate a change in the center of gravity 58 (shown in FIGS. 2-3) of the golf club head 10. It should be appreciated that the second magnets 124, 124*a* can be any suitable or desired mass (or weight). In addition the second magnets 124, 124*a* are different masses (or weights) (e.g., the second magnet 124*a* can have a mass or weight that is greater than the second magnet 124, the second magnet 124*a* can have a mass or weight that is less than the second magnet 124, etc.).

In some embodiments, the second magnet 124 can also include a screw head that is exposed to a user. The screw head is configured to receive a torque wrench to facilitate engagement (and disengagement) of the second magnet with the first magnet 140 within the weight mounting point 204. The screw head is illustrated as a star screw head, but in other embodiments, can be any suitable head suitable to receive a torque wrench or other device to facilitate engagement or disengagement of the second magnet 124 with the first magnet 120 within the weight mounting point 204. For example, in other embodiments, the second magnet 124 can comprise a protruding geometry capable of being received within a screw head on a tool to facilitate engagement or disengagement of the second magnet 124 with the first magnet 120 within the weight mounting point 204.

The second magnet 124 can be oriented (or reoriented) relative to the first magnet 120 into the first configuration, resulting in the second magnet 124 attaching to the first magnet 120 (or the first and second magnets 120, 124 magnetically engaging each other). To remove (or detach) the second magnet 124 from the weight mounting point 204, a user can rotate the second magnet 124 to orient the second magnet 124 relative to the first magnet 120 into the second configuration. In the second configuration, the weight 208 is free to be removed from the weight mounting point 204. Rotation of the second magnet 124 can be performed with the torque wrench (or other suitable device).

FIG. 8C illustrates another example of the magnetic adjustable weighting system 200, further including a weight 208. The weight mounting point 204 receives the corresponding weight 208 by programmed, correlated magnets 120, 124. More specifically, the second magnet 124 is coupled to the weight 208 by an adhesive. In other embodiments, the second magnet 124 can be coupled to the weight 208 by any suitable permanent (or semi-permanent) attachment (e.g., epoxy, glue, screw, rivets, etc.) or combination thereof. The weight 208 can also include a screw head that is exposed to a user. The screw head is configured to receive a torque wrench to facilitate engagement (and disengagement) of the weight 208 with the weight mounting point 204. The screw head is illustrated as a star screw head, but in other embodiments can be any suitable head suitable to receive a torque wrench or other device to facilitate engagement or disengagement of the weight 208 with the weight mounting point 204. For example, in other embodiments, the weight 508 can comprise a protruding geometry capable of being received within a screw head on a tool to facilitate engagement or disengagement of the weight 208 with the weight mounting point 204.

To attach the weight 208 to the weight mounting point 204, a user can position the weight 208 within the weight mounting point 204. The second magnet 124 is the oriented (or reoriented) relative to the first magnet 120 into the first configuration, resulting in the second magnet 124 attaching to the first magnet 120 (or the first and second magnets 120, 124 magnetically engaging each other). To remove (or detach) the weight 208 from the weight mounting point 204, a user can rotate the weight 208 (and associated second magnet 124) to orient the second magnet 124 relative to the first magnet 120 into the second configuration. In the second configuration the weight 208 is free to be removed from the weight mounting point 204. Rotation of the weight 208 (and associated second magnet 124) can be performed with the torque wrench (or other suitable device).

FIG. 9 illustrates another embodiment of the magnetic adjustable weighting system 300. The magnetic adjustable weighting system 300 has similar components to the magnetic adjustable weighting systems 100, 200 with like names and/or like numbers identifying like components. The magnetic adjustable weighting system 300 includes a weight mounting point 304, which is illustrated as a channel 304. The channel 304 is positioned on the sole 30 and extends between the toe 18 and the heel 22. Further, the channel 304 is positioned closer to the rear 42 than to the strike plate 34. In other embodiments, the channel 34 can be oriented to extend from the rear 42 towards the strike plate 34, or in any other suitable orientation. In yet other embodiments, the channel 304 can be positioned on the crown 26, another portion of the sole 30, or any other location on the body 14 of the golf club head 10.

The first magnet 120 is positioned within the channel 304. More specifically, the first magnet 120 is elongated and extends along a length of the channel 304. In other embodiments, a plurality of first magnets 120 can be positioned within and along the length of the channel 304.

The second magnet 124 is slidably received by (or in sliding engagement with) the channel 304. Accordingly, when the second magnet 124 is in the second configuration, the second magnet 124 can slide along the channel 304 while being retained in the channel 304 (i.e., the second magnet 124 does not have to be removed from the channel 304 during repositioning). Thus, the second magnet 124 can be slidably repositioned with respect to the channel to be closer to the toe 18, closer to the heel 22, or in a neutral position between the toe 18 and the heel 22 (e.g., equidistant from the toe 18 and heel 22, some other position within the channel 304 that is balanced or not weighted towards one of the toe 18 or the heel 22, etc.). Once the second magnet 124 is moved at a desired position in the channel 304, the second magnet 124 can be adjusted to the first configuration (e.g., the second magnet 124 can be rotated relative to the first magnet 120, etc.). In the first configuration, the second magnet 124 and the first magnet 120 attract, and are "locked" in that the second magnet 124 does not move relative to the first magnet 120. In other embodiments, the second magnet 124 can be removed from and repositioned at a different location within the channel 304.

Referring now to FIGS. 10A-C, another embodiment of the magnetic adjustable weighting system 400 is illustrated. The magnetic adjustable weighting system 400 has similar components to the magnetic adjustable weighting system 100, 200, 300 with like names and/or like numbers identifying like components. The magnetic adjustable weighting system 400 includes a channel 404 that is positioned between the strike plate 34 and the body 14 of the golf club head 10. A plurality of rods 408 extends between the strike plate 34 and the body 14. More specifically, two rods 408, which border opposing ends of the channel 404, extend between the strike plate 34 and the body 14. The rods 408 are slidably coupled to the strike plate 34. In other embodiments, one rod 408, or three or more rods 408 can extend between the strike plate 34 and the body 14.

Referring to FIG. 10A, two pairs of programmed, correlated magnets 120, 124 are positioned on opposing sides of the channel 404. Two first magnets 120 are positioned on one side of the channel 404, while two second magnets 124 are positioned on the opposite side of the channel 404. In the illustrated embodiment, the first magnets 120 are coupled to the body, and positioned on the body 14 side of the channel 404. The second magnets 124 are coupled to the strike plate 34, and positioned on the strike plate 34 side of the channel 404. In other embodiments, the first magnets 120 can be positioned on the strike plate 34 side of the channel 404, while the second magnets 124 can be positioned on the body 14 side of the channel 404. In other embodiments, at least one pair of programmed, correlated magnets 120, 124 is positioned on opposing sides of the channel 404.

For example, referring to FIGS. 10B and 10C, a single pair of programmed, correlated magnets 120, 124 are positioned on opposing sides of the channel. The magnets are positioned centrally relative to the strike plate 34. The first magnet 120 is coupled to the body, and positioned on the body 14 side of the channel 404. The second magnet 124 is coupled to the strike plate 34, and positioned on the strike plate 34 side of the channel 404, opposite the first magnet 120. In other embodiments, the first magnet 120 can be positioned on the strike plate 34 side of the channel 404, while the second magnet 124 can be positioned on the body 14 side of the channel 404.

The programmed, correlated magnets 120, 124 are programmed to interact as a spring, or have a biasing force between the magnets 120, 124. This biasing force generated by interaction of the pairs of correlated magnets 120, 124 maintains the strike plate 34 a specified distance from the body 14, limiting deflection of the strike plate 34 during impact with a golf ball. Stated another way, the strike plate 34 can float forward of the body 14, with the magnets 120, 124 maintaining the strike plate 34 a desired distance (e.g., 0.05 inches to 1.00 inches) away from the body 14. During impact with a golf ball, the strike plate 34 will deflect, or bend towards the body 14. The rods 408 guide the strike plate 34 during deflection to limit torque (or other rotation) and assist with maintaining the position of the strike plate 34 as parallel with the body 14. The magnets 120, 124 will allow the strike plate 34 to deflect a desired distance (e.g., 0.004 inches to 0.390 inches) before the magnets 120, 124 return the strike plate 34 to its original, non-deflected position.

FIGS. 11-12 illustrate another embodiment of the magnetic adjustable weighting system 500. The magnetic adjustable weighting system 500 has similar components to the magnetic adjustable weighting system 100, 200, 300, 400 with like names and/or like numbers identifying like components. The magnetic adjustable weighting system 500 is illustrated in association with a putter style golf club head 10. The putter can be a blade style (shown in FIG. 11), a mallet style (not shown), or any other style of putter.

With specific reference to FIG. 11, the magnetic adjustable weighting system 500 includes a plurality of weight mounting points 504*a, b*. A first weight mounting point 504*a* is positioned on the sole 30 towards the heel 22, and a second weight mounting point 504*b* is positioned on the sole 30 towards the toe 18. Each weight mounting point 504*a, b* is a recess configured to receive a weight 508. In other embodiments, the golf club head 10 can have a single weight mounting point 504, or three, four, five, or six or more weight mounting points 504. The weight mounting points 504 can be positioned at different locations on the sole 30, and/or on the toe 18, on the heel 22, on the back 42, on the strike plate 34, or any other suitable or desired location on the body 14.

Each weight mounting point 504 receives the corresponding weight 508 by a magnet assembly of programmed, correlated magnets 120, 124. More specifically, each weight mounting point 504 comprises a first magnet 120 and a second magnet 124. Referring to FIGS. 11 and 12, in the illustrated embodiment, the first weight mounting point 504*a* includes a first magnet assembly comprising a first magnet 120 and a second magnet 124. Further, the second weight mounting point 504*b* includes a second magnet assembly comprising a first magnet 120 and a second magnet 124. The second magnet of the first and second magnet assemblies is configured to couple to the weight 508.

In many embodiments, the second magnet 124 of the first magnet assembly is coupled to a first weight, and the second magnet 124 of the second magnet assembly is coupled to a second weight, different than the first weight. In many embodiments, the second magnet 124 and first weight 508 of the first magnet assembly, and the second magnet 124 and second weight 508 of the second magnet assembly can be removed from their respective weight mounting points 504*a*, 504*b*, and exchanged or replaced by different magnets and/or weights to adjust the center of gravity and trajectory bias of the club head 10.

As illustrated in FIG. 12, the weight mounting points 504*a* and 504*b* include the first magnet 120. More specifically, the first magnet 120 is received by the weight mounting points 504*a* and 504*b*. The first magnet 120 is coupled to the interior of the weight mounting point 504*a*, 504*b* (or to a portion of the body 14 of the golf club head 10) by an adhesive. In other embodiments, the first magnet 120 can be coupled to the weight mounting point 504*a*, 504*b* by any suitable permanent (or semi-permanent) attachment (e.g., epoxy, glue, screw, rivets, etc.) or combination thereof. The first magnet 120 has a shape that generally conforms to the shape of the weight mounting point 504*a*, 504*b*. While the first magnet 120 illustrated in FIGS. 11 and 12 has a circular shape that is configured to be received in a cylindrical shape of the weight mounting point 504*b*, in other embodiments the first magnet 120 can be any suitable shape (e.g., triangular, square, oval, polygonal, etc.). In the illustrated embodiment, each weight mounting point 504 has a diameter that is slightly larger than the associated magnet 120, 124. More specifically, each mounting point 504 is approximately 0.05 inches larger than the diameter of the magnet 120, 124. In other embodiments, each mounting point 504 can have a diameter (or size) that is the same as the diameter (or size) of each associated magnet 120, 124. In yet other embodiments, each mounting point 504 can have a diameter (or size) that is larger than the diameter (or size) of each associated magnet 120, 124. More specifically, each mounting point 504 can have a diameter (or size) that is approximately 0.01 inches to approximately 0.10 inches larger than each associated magnet 120, 124, and more specifically approximately 0.025 inches to approximately 0.075 inches larger than each associated magnet 120, 124, and more specifically at least 0.05 inches larger than each associated magnet 120, 124. In addition, each weight mounting point 504 can have a taper or slope or draft to improve ease of insertion of each associated magnet 120. For example, in the illustrated embodiment, each weight mounting point 504 includes a 1.00° draft. In other embodiments, each weight mounting point 504 can include approximately a 0.25° draft to approximately a 2.00° draft, and more specifically a 0.50° draft to approximately a 1.75° draft, and more specifically a 0.75° draft to approximately a 1.50° draft, and more specifically at least a 1.00° draft. In other embodiments, each weight mounting point 504 can include no draft (or a 0° draft).

The second magnet 124 of the first and second magnet assemblies is coupled to the weight 508 by an adhesive. In other embodiments, the second magnet 124 can be coupled to the weight 508 by any suitable permanent (or semi-permanent) attachment (e.g., epoxy, glue, screw, rivets, etc.) or combination thereof. The weight 508 can also include a screw head that is exposed to a user. The screw head is configured to receive a torque wrench to facilitate engagement (and disengagement) of the weight 508 with the weight mounting point 504. The screw head is illustrated as a star screw head, but in other embodiments can be any suitable head suitable to receive a torque wrench or other device to facilitate engagement or disengagement of the weight 508 with the weight mounting point 504.

To attach the weight 508 to the weight mounting point 504, a user can position the weight 508 within the weight mounting point 504. The second magnet 124 is the oriented (or reoriented) relative to the first magnet 120 into the first configuration, resulting in the second magnet 124 attaching to the first magnet 120 (or the first and second magnets 120, 124 magnetically engaging each other). To remove (or detach) the weight 508 from the weight mounting point 504, a user can rotate the weight 508 (and associated second magnet 124) to orient the second magnet 124 relative to the first magnet 120 into the second configuration. In the second configuration the weight 508 is free to be removed from the weight mounting point 504. Rotation of the weight 508 (and associated second magnet 124) can be performed with the torque wrench (or other suitable device).

The weight 508 can be included with a plurality of weights 508 having varying masses or weight. For example, the weight 508 can be a part of a weight kit that includes a plurality of pairs of weights 508 (e.g., two 5 gram weights, two 10 gram weights, two 15 gram weights, two 20 gram weights, etc.). In other embodiments, the weights 508 can be 0.5 grams to 40 grams. A user can change a swing weight, a total weight, the center of gravity 58, and/or the moment of inertia of the golf club head 10 by changing one or more of the weights 508 (e.g., two 5 gram weights can be replaced with two 20 gram weights, etc.).

Clause 1: A golf club head comprising a club body having a crown opposite a sole, a toe end opposite a heel end, a back end, and a hosel; a first magnet configured to be coupled to the club body; and a second magnet selectively engageable with the first magnet, wherein in a first configuration the first and second magnets attract, and in a second configuration the first and second magnets do not attract, wherein the second magnet is configured to rotate relative to the first magnet between the first configuration and the second configuration.

Clause 2: The golf club head of clause 1, wherein the first magnet is coupled to the sole.

Clause 3: The golf club head of clause 1, wherein the first magnet is coupled to a weight mounting point.

Clause 4: The golf club head of clause 3, wherein the weight mounting point is positioned on the sole.

Clause 5: The golf club head of clause 3, wherein the weight mounting point is positioned in a channel formed in the sole.

Clause 6: The golf club head of clause 1, wherein the second magnet is configured to rotate relative to the first magnet in a first direction to achieve the first configuration, and in a second direction to achieve the second configuration.

Clause 7: The golf club head of clause 6, wherein the first direction is opposite the second direction.

Clause 8: The golf club head of clause 6, wherein the first direction is the same as the second direction.

Clause 9: The golf club head of clause 1, wherein the first and second magnets are programmed with multi-pole structures arranged in a defined pattern.

Clause 10: The golf club head of clause 1, wherein the second magnet includes a weight.

Clause 11: The golf club head of clause 10, wherein the second magnet includes a first weight, and further comprising a third magnet, the third magnet includes a second weight, the second and third magnets are configured to separately selectively engage the first magnet, the first weight has a first mass, the second weight has a second mass, the first mass being different than the second mass.

Clause 12: A golf club head comprising: a club body having a crown opposite a sole, a toe end opposite a heel end, a back end, and a hosel; a channel formed in the sole; a programmed magnet pair including a first magnet and a second magnet, the first magnet positioned in the channel, and the second magnet configured to operatively couple to the first magnet, wherein in a first configuration the first and second magnets attract, and in a second configuration the first and second magnets do not attract.

Clause 13: The golf club head of clause 12, wherein the second magnet is slidably received by the channel.

Clause 14: The golf club head of clause 13, wherein the second magnet is configured to slide relative to the channel in the second configuration.

Clause 15: The golf club head of clause 12, wherein the channel is a first channel, and further comprising a second channel, the first and second channels together define a recess.

Clause 16: The golf club head of clause 15, further comprising a plurality of first magnets, at least one first magnet being positioned in the first channel, and at least one first magnet being positioned in the second channel.

Clause 17: The golf club head of clause 16, wherein each first magnet defines a weight mounting point, the second magnet being configured to attach to one of the first magnets at each weight mounting point.

Clause 18: The golf club head of clause 16, further comprising a third channel further defining the recess, at least one first magnet being positioned in the third channel.

Clause 19: The golf club head of clause 12, wherein the second magnet is configured to rotate relative to the first magnet between the first configuration and the second configuration.

Clause 20: The golf club head of clause 19, wherein the second magnet is configured to rotate relative to the first magnet in a first direction to achieve the first configuration, and in a second direction to achieve the second configuration.

Clause 21: A golf club head comprising: a club body having a crown opposite a sole, a toe end opposite a heel end, a back end, and a hosel; and a programmed magnet pair including a first magnet and a second magnet, wherein the first magnet is configured to be coupled to the club body, and the second magnet is configured to selectively couple to the first magnet.

Clause 22: The golf club head of clause 21, wherein the second magnet comprises a weight.

Clause 23: The golf club head of clause 21, wherein the second magnet is coupled to a weight.

Clause 24: The golf club head of clause 21, wherein the club body includes a recess, the first magnet is configured to be received by the recess.

Clause 25: The golf club head of clause 24, wherein the second magnet is configured to selectively couple to the first magnet in the recess.

Clause 26: A golf club head comprising: a club body having a crown opposite a sole, a toe end opposite a heel end, a back end, and a hosel; a first magnet coupled to the club body; a second magnet configured to operatively connect to the first magnet; and a third magnet configured to operatively connect to the first magnet, wherein the first and second magnets are a first programmed magnet pair, and the first and third magnets are a second programmed magnet pair.

Clause 27: The golf club head of clause 26, wherein the second magnet has a first weight, and the third magnet has a second weight, the first weight being different than the second weight.

Clause 28: The golf club head of clause 26, wherein the second magnet is coupled to a first weight, and the third magnet is coupled to a second weight, the first weight being different than the second weight.

Clause 29: The golf club head of clause 26, wherein the club body includes a recess, the first magnet is configured to be received by the recess.

Clause 30: A golf club head comprising: a club body having a crown opposite a sole, a toe end opposite a heel end, a back end, and a hosel; a first magnet assembly having a first magnet coupled to the club body and a second magnet configured to operatively connect to the first magnet of the first magnet assembly; a second magnet assembly having a first magnet coupled to the club body and a second magnet configured to operatively connect to the first magnet of the second magnet assembly; wherein the first and second magnets of the first magnet assembly are a first programmed magnet pair, and the first and second magnets of the second magnet assembly are a second programmed magnet pair.

Clause 31: The golf club head of clause 30, wherein the second magnet of the first magnet assembly has a first weight, and the second magnet of the second magnet assembly has a second weight, the first weight being different than the second weight.

Clause 32: The golf club head of clause 30, wherein the second magnet of the first magnet assembly is coupled to a first weight, and the second magnet of the second magnet assembly is coupled to a second weight, the first weight being different than the second weight.

Clause 33: The golf club head of clause 30, wherein the club body includes a recess, the first magnet is configured to be received by the recess.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A putter-type golf club head comprising:

a putter-type club body having a crown opposite a sole, a toe end opposite a heel end, a back end, a hosel, a front end comprising a face plate, a first weight mounting point in the sole, and a second weight mounting point in the sole;

wherein the first weight mounting point comprises a first recess, and the second weight mounting point comprises a second recess;

wherein the first recess is adjacent to the toe end, and the second recess is adjacent to the heel end;

wherein each of the first and second weight mounting points comprises a first and second magnet assembly;

wherein the first magnet assembly and the second magnet assembly each comprise a first magnet and a second magnet;

wherein the putter-type golf club head further comprises a first and second weight;

wherein the first weight mounting point is configured to receive the first weight and the first magnet assembly and the second weight mounting point is configured to receive the second weight and the second magnet assembly respectively; and wherein each first magnet and each second magnet have a pull force of between approximately 10 and approximately 50 pound-force.

2. The putter-type golf club head of claim 1, wherein the first magnet of each magnet assembly is adhesively coupled to each weight mounting point.

3. The putter-type golf club head of claim 1, wherein the first magnet assembly is coupled to the first weight and the second magnet assembly is coupled to the second weight.

4. The putter-type golf club head of claim 1, wherein the second magnet of the first magnet assembly is coupled to the first weight and the second magnet of the second magnet assembly is coupled to the second weight.

5. The putter-type golf club head of claim 1, wherein the second magnet and first weight of the first magnet assembly, and the second magnet and second weight of the second magnet assembly can be removed from the first and second weight mounting points respectively and exchanged with each other.

6. The putter-type golf club head of claim 1, wherein the second magnet of the first magnet assembly and the second magnet of the second magnet assembly comprise a first mass in a range of 0.10 grams to 50 grams.

7. The putter-type golf club head of claim 1, wherein the second magnet of the first magnet assembly and the second magnet of the second magnet assembly may each comprise a different mass.

8. The putter-type golf club head of claim 1, wherein the first weight mounting point and the second weight mounting point further comprise a cylindrical recess.

9. The putter-type golf club head of claim 1, wherein the first and second magnet of the first magnet assembly and the first and second magnet of the second magnet assembly are made of NdFeB.

10. The putter-type golf club head of claim 1, wherein the first and second magnet of the first magnet assembly and the first and second magnet of the second magnet assembly comprise a material selected from a group consisting of iron ferrites, tungsten, aluminum, steel, chromium, nickel, vanadium, lomedium, rare-earth metals, and ceramics.

11. The putter-type golf club head of claim 1, wherein the second magnet of the first magnet assembly and the second magnet of the second magnet assembly comprise a diameter in a range of 0.25 inch to 2.00 inches.

12. The putter-type golf club head of claim 1, wherein the second magnet of the first magnet assembly and the second magnet of the second magnet assembly comprise a thickness in a range of 0.075 inch to 1.750 inches.

13. The putter-type golf club head of claim 1, wherein the second magnet of the first magnet assembly is adhesively coupled to the first weight and the second magnet of the second magnet assembly is adhesively coupled to the second weight.

* * * * *